US009584927B2

(12) United States Patent
Greenbush

(10) Patent No.: US 9,584,927 B2
(45) Date of Patent: Feb. 28, 2017

(54) WIRELESS ENVIRONMENT INTERFERENCE DIAGNOSTIC HEARING ASSISTANCE DEVICE SYSTEM

(71) Applicant: Starkey Laboratories, Inc., Eden Prairie, MN (US)

(72) Inventor: Neil Greenbush, Eden Praire, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 198 days.

(21) Appl. No.: 14/209,954

(22) Filed: Mar. 13, 2014

(65) Prior Publication Data

US 2014/0270213 A1 Sep. 18, 2014

Related U.S. Application Data

(60) Provisional application No. 61/801,152, filed on Mar. 15, 2013.

(51) Int. Cl.
*H04R 29/00* (2006.01)
*H04R 25/00* (2006.01)

(52) U.S. Cl.
CPC ..... *H04R 25/30* (2013.01); *H04R 25/554* (2013.01); *H04R 25/70* (2013.01)

(58) Field of Classification Search
CPC ..... H04R 25/30; H04R 25/70; H04R 25/554
See application file for complete search history.

(56) References Cited

U.S. PATENT DOCUMENTS 5,479,522 A 12/1995 Lindemann et al.
5,956,330 A 9/1999 Kerns
(Continued)

FOREIGN PATENT DOCUMENTS

EP 1033022 A2 9/2000
EP 1554597 A2 7/2005
(Continued)

OTHER PUBLICATIONS

"U.S. Appl. No. 13/843,725, Non Final Office Action mailed Feb. 6, 2015", 14 pgs.
(Continued)

*Primary Examiner* — Davetta W Goins
*Assistant Examiner* — Daniel Sellers
(74) *Attorney, Agent, or Firm* — Schwegman Lundberg & Woessner, P.A.

(57) ABSTRACT

Disclosed herein, among other things, are methods and apparatus for wireless interference diagnostic hearing assistance device systems. One aspect of the present subject matter includes a method for assessing and mitigating wireless interference for hearing assistance device programmers. The method includes measuring wireless interference over wireless communication channels using a wireless programmer configured to communicate with a hearing assistance device. A graphical display in communication with the wireless programmer is used to assist or direct a user to physically move the wireless programmer or the hearing assistance device to minimize the measured wireless interference. In various embodiments, the measured wireless interference is used to identify a source of the wireless interference, and an identity of the source of the wireless interference is displayed on the graphical display.

19 Claims, 6 Drawing Sheets

(56) References Cited

U.S. PATENT DOCUMENTS

| | | | | |
|---|---|---|---|---|
| 6,067,449 | A | 5/2000 | Jager | |
| 6,466,832 | B1 | 10/2002 | Zuqert et al. | |
| 7,359,701 | B2 | 4/2008 | Zhao et al. | |
| 7,369,510 | B1 | 5/2008 | Wong et al. | |
| 7,583,625 | B2 | 9/2009 | Bennett | |
| 7,688,991 | B2 | 3/2010 | Baechler | |
| 7,873,377 | B1 | 1/2011 | Cocos | |
| 8,081,787 | B2 | 12/2011 | Haenggi et al. | |
| 8,249,512 | B2 | 8/2012 | Prather | |
| 8,331,869 | B2 | 12/2012 | Foegelle | |
| 8,340,590 | B2 | 12/2012 | Zhao et al. | |
| 8,442,248 | B2 | 5/2013 | Solum et al. | |
| 8,571,678 | B2 | 10/2013 | Wang | |
| 9,084,064 | B2 | 7/2015 | Solum | |
| 9,497,553 | B2 | 11/2016 | Solum et al. | |
| 2005/0078844 | A1 | 4/2005 | Von Ilberg | |
| 2005/0100182 | A1 | 5/2005 | Sykes et al. | |
| 2005/0245286 | A1* | 11/2005 | Lin | G01S 3/30 455/562.1 |
| 2006/0274747 | A1 | 12/2006 | Duchscher et al. | |
| 2007/0049983 | A1 | 3/2007 | Freeberg | |
| 2007/0086601 | A1 | 4/2007 | Mitchler | |
| 2007/0153745 | A1 | 7/2007 | Sun et al. | |
| 2008/0240453 | A1 | 10/2008 | Westergaard | |
| 2009/0046625 | A1* | 2/2009 | Diener | H04L 1/0001 370/319 |
| 2009/0316922 | A1* | 12/2009 | Merks | H04R 25/30 381/60 |
| 2010/0054512 | A1 | 3/2010 | Solum | |
| 2010/0161208 | A1 | 6/2010 | Akita et al. | |
| 2011/0022916 | A1 | 1/2011 | Desai et al. | |
| 2011/0067082 | A1 | 3/2011 | Walker | |
| 2011/0085687 | A1 | 4/2011 | Edgar | |
| 2011/0216809 | A1 | 9/2011 | Gan et al. | |
| 2011/0312282 | A1 | 12/2011 | Prather | |
| 2012/0021386 | A1 | 1/2012 | Anderson et al. | |
| 2013/0034005 | A1 | 2/2013 | Xhafa et al. | |
| 2013/0251180 | A1 | 9/2013 | Solum | |
| 2014/0270211 | A1 | 9/2014 | Solum et al. | |
| 2014/0270288 | A1 | 9/2014 | Kryzer | |
| 2016/0072596 | A1 | 3/2016 | Solum | |

FOREIGN PATENT DOCUMENTS

| | | | |
|---|---|---|---|
| EP | 1609316 | A2 | 12/2005 |
| EP | 1860914 | B1 | 11/2007 |
| EP | 1980132 | B1 | 10/2008 |
| EP | 2103176 | B1 | 5/2011 |
| EP | 2328370 | A1 | 6/2011 |
| EP | 2779698 | A2 | 9/2014 |
| EP | 2779699 | A2 | 9/2014 |
| EP | 2779700 | A1 | 9/2014 |
| WO | WO-2007068243 | A1 | 6/2007 |
| WO | WO-2009063097 | A2 | 5/2009 |

OTHER PUBLICATIONS

"U.S. Appl. No. 13/843,725, Notice of Allowance mailed Jun. 5, 2015", 5 pgs.
"U.S. Appl. No. 13/843,725, Response filed May 6, 2015 to Non Final Office Action mailed Feb. 6, 2015", 9 pgs.
"U.S. Appl. No. 13/843,852, Advisory Action mailed Nov. 18, 2014", 3 pgs.
"U.S. Appl. No. 13/843,852, Final Office Action mailed Sep. 8, 2014", 13 pgs.
"U.S. Appl. No. 13/843,852, Non Final Office Action mailed Apr. 29, 2015", 14 pgs.
"U.S. Appl. No. 13/843,852, Non Final Office Action mailed May 19, 2014", 12 pgs.
"U.S. Appl. No. 13/843,852, Response filed Aug. 19, 2014 to Non Final Office Action mailed May 19, 2014", 13 pgs.
"U.S. Appl. No. 13/843,852, Response filed Nov. 10, 2014 to Final Office Action mailed Sep. 8, 2014", 10 pgs.
"U.S. Appl. No. 13/893,158, Non Final Office Action mailed Aug. 25, 2014", 17 pgs.
"U.S. Appl. No. 13/893,158, Notice of Allowance mailed Mar. 12, 2015", 8 pgs.
"U.S. Appl. No. 13/893,158, Response filed Nov. 25, 2014 to Non Final Office Action mailed Aug. 25, 2014", 13 pgs.
"European Application Serial No. 14159982.9, Extended European Search Report mailed Jul. 1, 2014", 7 pgs.
"European Application Serial No. 14159982.9, Response filed Apr. 9, 2015 to Extended European Search Report mailed Jul. 1, 2014", 16 pgs.
Bresciani, Laurent, "Wireless Signal Stats Plug-In", Wildpackets, (May 2, 2012), 2 pgs.
"U.S. Appl. No. 12/552,513, Non Final Office Action mailed Jul. 2, 2012", 19 pgs.
"U.S. Appl. No. 12/552,513, Notice of Allowance mailed Jan. 14, 2013", 9 pgs.
"U.S. Appl. No. 12/552,513, Response filed Oct. 2, 2012 to Non Final Office Action mailed Jul. 2, 2012", 12 pgs.
"U.S. Appl. No. 13/893,158, Preliminary Amendment filed May 31, 2013", 9 pgs.
"U.S. Appl. No. 13/843,725, Non Final Office Action mailed Oct. 26, 2015", 16 pgs.
"U.S. Appl. No. 13/843,852, Advisory Action mailed Oct. 22, 2015", 3 pgs.
"U.S. Appl. No. 13/843,852, Final Office Action mailed Aug. 13, 2015", 15 pgs.
"U.S. Appl. No. 13/843,852, Preliminary Amendment filed Mar. 11, 2014", 6 pgs.
"U.S. Appl. No. 13/843,852, Response filed Jul. 29, 2015 to Non Final Office Action mailed Apr. 29, 2015", 9 pgs.
"U.S. Appl. No. 13/843,852, Response filed Oct. 13, 2015 to Final Office Action mailed Aug. 13, 2015", 10 pgs.
"U.S. Appl. No. 13/843,852, Response filed Nov. 13, 2015 to Advisory Action mailed Oct. 22, 2015", 9 pgs.
"U.S. Appl. No. 13/843,725, Final Office Action mailed Mar. 3, 2016", 19 pgs.
"U.S. Appl. No. 13/843,725, Response filed Jan. 27, 2016 to Non Final Office Action mailed Oct. 26, 2015", 11 pgs.
"U.S. Appl. No. 13/843,852, Non Final Office Action mailed Feb. 25, 2016", 14 pgs.
"U.S. Appl. No. 13/843,725, Response filed Jun. 30, 2016 to Final Office Action mailed Mar. 3, 2016", 12 pgs.
"U.S. Appl. No. 13/843,725, Notice of Allowance mailed Jul. 19, 2016", 5 pgs.
"U.S. Appl. No. 14/797,816, Non Final Office Action mailed Jul. 14, 2016", 8 pgs.
"European Application Serial No. 14159963.9, Extended European Search Report mailed Jun. 8, 2016", 7 pgs.
"European Application Serial No. 14159967.0, Extended European Search Report mailed Jun. 3, 2016", 7 pgs.
"U.S. Appl. No. 14/797,816, Response filed Nov. 14, 2016 to Non Final Office Action mailed Jul. 14, 2016", 6 pgs.

* cited by examiner

WIRELESS ENVIRONMENT INTERFERENCE DIAGNOSTIC HEARING ASSISTANCE DEVICE SYSTEM

CROSS REFERENCE TO RELATED APPLICATION

The present application claims the benefit under 35 U.S.C. §119(e) of U.S. Provisional Patent Application 61/801,152, filed Mar. 15, 2013, the disclosure of which is hereby incorporated by reference herein in its entirety.

This application is related to co-pending, commonly assigned U.S. patent application Ser. No. 12/552,513, entitled "SYSTEMS AND METHODS FOR MANAGING WIRELESS COMMUNICATION LINKS FOR HEARING ASSISTANCE DEVICES", filed on Sep. 2, 2009, U.S. patent application Ser. No. 13/843,725, entitled "HEARING ASSISTANCE DEVICE WIRELESS TEST MODES AS A DIAGNOSTIC TOOL", filed Mar. 15, 2013, and U.S. patent application Ser. No. 13/843,852, entitled "METHOD AND APPARATUS TO DISPLAY INTERFERENCE FOR A WIRELESS HEARING ASSISTANCE DEVICE PROGRAMMER", filed on Mar. 15, 2013, all of which are hereby incorporated by reference herein in their entirety.

TECHNICAL FIELD

This document relates generally to hearing assistance systems and more particularly to methods and apparatus for wireless interference diagnostic hearing assistance device systems.

BACKGROUND

Modern hearing assistance devices, such as hearing aids, are electronic instruments worn in or around the ear that compensate for hearing losses by specially amplifying sound. Wearers of hearing aids undergo a process called "fitting" to adjust hearing aid settings to their particular hearing and use. In such fitting sessions the wearer may select one setting over another, much like selecting one setting over another setting in an eye test. After the initial fitting process, the wearer may desire further adjustments of hearing aid settings to further tune the device and/or to match different acoustic environments.

Hearing aid settings are adjusted through a programmer that is attached to a personal computer (PC) and that allows a hearing professional, such as an audiologist, to make changes via a software graphical user interface. The programmer communicates from the PC to the hearing aids through either a wired or wireless communication protocol. A wireless programmer is unable to properly communicate with hearing aids when wireless interference is present. Using a spectrum analyzer can help measure and identify wireless interference, but such devices are expensive and most hearing professionals do not have spectrum analyzers available in their offices.

Accordingly, there is a need in the art for improved systems and methods for assessing and mitigating wireless interference for hearing assistance device programmers.

SUMMARY

Disclosed herein, among other things, are methods and apparatus for wireless interference diagnostic hearing assistance device systems. One aspect of the present subject matter includes a method for assessing and mitigating wireless interference for hearing assistance device programmers. The method includes measuring a level of wireless interference over wireless communication channels using a wireless programmer configured to communicate with a hearing assistance device. A graphical display in communication with the wireless programmer is used to assist or direct a user to physically move the wireless programmer or the hearing assistance device to minimize the level of measured wireless interference, in various embodiments.

One aspect of the present subject matter includes a method for measuring and identifying sources of wireless interference for hearing assistance device programmers. The method includes measuring wireless interference over wireless communication channels for a wireless hearing assistance device programmer. In various embodiments, the measured wireless interference is used to identify a source of the wireless interference. An identity of the source of the wireless interference is displayed on a graphical display in communication with the wireless programmer, according to various embodiments.

One aspect of the present subject matter includes a hearing assistance system for a wearer including a wireless hearing assistance device programmer configured to wirelessly communicate with a hearing assistance device using at least one of a plurality of channels. The system also includes a graphical display in communication with the wireless programmer. The wireless programmer is configured to measure wireless interference over the plurality of channels. The graphical display is configured to provide assistance to a user to physically move the wireless programmer or the hearing assistance device to minimize the measured wireless interference, according to various embodiments. In various embodiments, the system is configured to identify a source of the measured interference and present the identity of the source on the graphical display.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
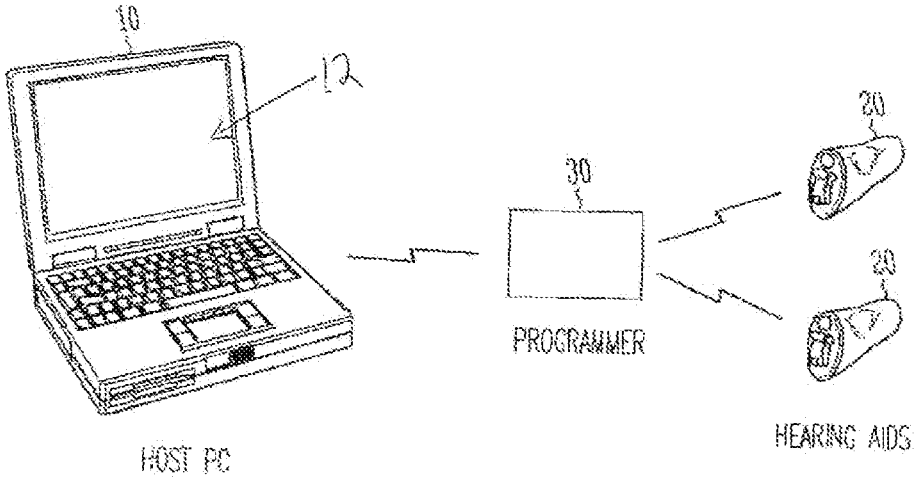
FIG. 1 is a block diagram of hearing assistance devices and programming equipment, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing aid settings are adjusted through a programmer that is attached, either wired or wirelessly, to a personal computer (PC) and that allows a hearing professional to make changes via a software graphical user interface. A wireless programmer is unable to properly communicate with hearing aids when wireless interference is present. Using a spectrum analyzer can help measure and identify wireless interference, but such devices are expensive and most hearing professionals do not have spectrum analyzers available in their offices. Therefore, what is needed in the art is an improved system and method for assessing and mitigating wireless interference for hearing assistance device programmers.

Disclosed herein, among other things, are methods and apparatus for wireless interference diagnostic hearing assistance device systems. One aspect of the present subject matter includes a hearing assistance system for a wearer including a wireless hearing assistance device programmer configured to wirelessly communicate with a hearing assistance device using at least one of a plurality of channels. The system also includes a graphical display in communication with the wireless programmer. The wireless programmer is configured to measure level of wireless interference over the plurality of channels. The graphical display is configured to provide assistance, such as feedback of interference, connection and/or detection levels and/or directions, to a user to physically move the wireless programmer or the hearing assistance device to minimize the level of measured wireless interference, according to various embodiments. In various embodiments, the system is configured to identify a source of the measured interference.

The present subject matter provides a system to diagnose and mitigate an interference source in the detection, connection, and programming of wireless hearing assistance devices. An object of the present subject matter is to assist a customer/user find an optimal placement for a wireless programmer or patient wearing a hearing assistance device. Previously, if there were drops/failures in wireless detection and connection, the customer would run wireless diagnostics, obtain a log file and email the log file to customer support for assistance with the problem. A diagnostic application in programming software can be used to test the discovery and programming channels and provide a combined percentage score for each along with a pass or fail for the log file.

The present system provides several benefits including reducing time spent by engineers and support staff interpreting log files. The present subject matter provides the customer possible specific devices or objects causing the interference based on quality scores and/or measured interference. For example, a wireless headset will potentially give off different interference compared to a wireless router or alarm system. The present application also assists with placement of the programmer and patient/device to improve wireless communication. In one embodiment, the present subject matter provides real-time quality scores of communications between the programmer and devices, along with a measured interference level. In various embodiments, the present system has the user physically move the programmer or patient/device around a room until an optimal combination of detection/programming and/or low interference is met. An assessment is provided on the current wireless environment for programming wireless hearing aids dependent on the device technology, not just a general quality, in various embodiments. The present subject matter can identify known interferers with hearing aids and ignore those which do not cause problems for wireless hearing assistance device communications.

According to various embodiments, the present subject matter can be implemented as a software application, either on a personal computer in communication with the wireless programmer, or on the wireless programmer itself. The system provides an analysis of the quality on the current wireless environment for the wireless programmer and hearing assistance devices. The present subject matter uses the derived link quality assessment (LQA) scores from the Receive Signal Strength Indicator (RSSI) values in the current environment (discussed below), as well as a "Communications Test Platform Wizard" (CTPW) to assess the quality of the link between the programmer and hearing aid, in various embodiments. The present system and methods allow the user to test both wireless discovery and programming channels, but instead of generating a log file containing these scores (which are calculated and represented as pass or fail indicator along with an overall quality percentage rate), interference is measured and possible causes of the interference (e.g. Receptionists headset, cell phones, radio tower, etc.) are displayed for the user.

In various embodiments, the present subject matter provides a method for the user to move the programmer or devices to find an optimal placement for either/both within the office or programming area. A visual indicator will inform the user when the best communication is occuring between the hearing aid and programmer, in various embodiments. According to various embodiments, directions are provided to the user for moving the programmer and/or hearing assistance devices to minimize interference and improve connection/detection. If there is unknown or out-of-band interference, logs will be generated and can be sent to customer support, in the same manner as the current wireless diagnostic application. In additional embodiments, the present subject matter can run on other platforms, such as mobile devices or servers to assist with assessing and mitigating wireless interference. Benefits of the present subject matter includes reducing the amount of time spent processing customer support emails/issues, by providing a method for users to more easily diagnose wireless programming issues on-site rather than having to email diagnostic files to customer support to have them diagnose the probable cause.

The present subject matter assesses link quality for a wireless programmer in communication with one or more hearing assistance devices. An example of this assessment can be found in to co-pending, commonly assigned, U.S. patent application Ser. No. 12/552,513, entitled "SYSTEMS AND METHODS FOR MANAGING WIRELESS COMMUNICATION LINKS FOR HEARING ASSISTANCE DEVICES", filed on Sep. 2, 2009, which is hereby incorporated by reference in its entirety.

FIG. 1 is a block diagram of hearing assistance devices and programming equipment according to one embodiment of the present subject matter. FIG. 1 shows a host computer 10 in communication with the hearing assistance devices 20. In one application, the hearing assistance devices 20 are hearing aids. Other hearing assistance devices and hearing aids are possible without departing from the scope of the present subject matter. Wireless programmer 30 functions to facilitate communications between the host computer 10 and the hearing assistance devices 20 (e.g., hearing aids) to fit and adjust the devices, and may contain additional functionality and programming in various embodiments. Other numbers of programmers and devices can be used without departing from the scope of the present subject matter.

Host computer 10 is adapted to execute adjusting/fitting software that takes inputs from devices such as a keyboard and mouse for adjusting/fitting one or more hearing assistance device. Options are displayed for adjusting parameters one a computer screen or other graphical display 12. As discussed below, the present subject matter further uses measured wireless interference to assist a user in moving or locating a wireless programmer or a hearing assistance device to minimize interference, and/or to identify a source of the interference and display the identity of the source on a graphical display, such as display 12, in various embodiments. It is understood that the user may be the wearer of one or more hearing aids or can be a clinician, audiologist or other attendant assisting with the use of the adjusting/fitting system. In various embodiments, the system includes memory which stores and displays one or more user selections for the fitting system. It is understood that the configuration shown in FIG. 1 is demonstrative and is not intended in an exhaustive or exclusive sense. Other configurations may exist without departing from the scope of the present subject matter. For example, the display 12 can be located on the programmer 30 or in another external device connected to the programmer directly or indirectly, such as through an internet connection. In addition, it is possible that the memory may be encoded in firmware, software, or combinations thereof.

In various embodiments, a wireless programmer 30 is capable measuring the interference in order to choose a free channel, as discussed below with respect to FIGS. 5-8. The present subject matter provides an application that uses link quality assessment (LQA) data from the fitting software application for available channels, in an embodiment.

Figure 2:
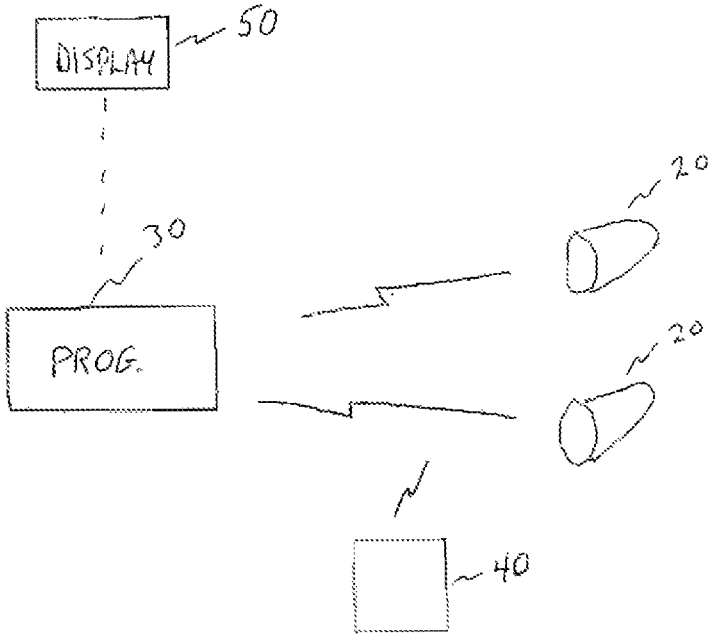
FIG. 2 is a block diagram of hearing assistance devices, an interference source and programming equipment, according to various embodiments of the present subject matter.

FIG. 2 is a block diagram of hearing assistance devices 20, an interference source 40 and programming equipment 30, according to various embodiments of the present subject matter. A wireless hearing assistance device programmer 30 configured to wirelessly communicate with a hearing assistance device 20 using at least one of a plurality of channels. The system also includes a graphical display 50, such as display 12 in FIG. 1, in communication with the wireless programmer. The display 50 may be wired or wirelessly connected to the programmer 30, either directly or indirectly, in various embodiments. The wireless programmer 30 is configured to measure wireless interference over the plurality of channels. In other embodiments, a personal computer (such as PC 10 in FIG. 1) measures the wireless interference. In still other embodiments, a combination of the wireless programmer 30 and a PC measure the wireless interference. The graphical display 50 is configured to provide assistance and/or direction to a user to physically move the wireless programmer or the hearing assistance device to minimize the level of measured wireless interference, according to various embodiments. In some embodiments, the display 50 shows instructions to direct the user. In further embodiments, the display 50 provides real-time or near real-time feedback of measured interference data and/or connection and/or detection levels to the user in response to the user moving the programmer 30. In still further embodiments, the display 50 provides instructions together with feedback.

In various embodiments, the system is configured to identify a source 40 of the measured interference. In various embodiments, the programmer identifies the source, and in other embodiments a personal computer in communication with the programmer identifies the source. According to various embodiments, the graphical display 50 is configured to display an identity of the source of the measured wireless interference. The graphical display 50 includes a graphical display attached to a personal computer in communication with the wireless programmer, in an embodiment. In another embodiment, the graphical display 50 includes a graphical display on the wireless programmer.

Figure 3:
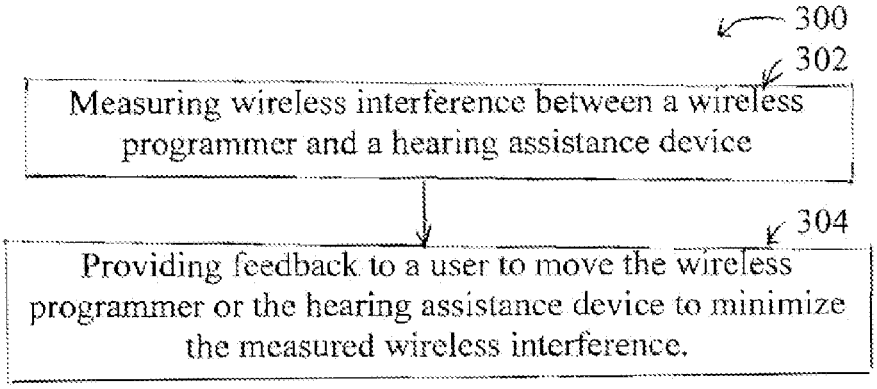
FIG. 3 illustrates a flow diagram of a method for assessing and mitigating wireless interference for hearing assistance device programmers, according to various embodiments of the present subject matter.

FIG. 3 illustrates a flow diagram of a method 300 for assessing and mitigating wireless interference for hearing assistance device programmers, according to various embodiments of the present subject matter. At 302, wireless interference is measured between a wireless programmer and a hearing assistance device. At 304, feedback is provided to a user to move the wireless programmer or the hearing assistance device to minimize the measured wireless interference. Instead of or in addition to feedback, the system can direct a user how to move the programmer or the hearing assistance device to minimize a level of interference, or to increase connection and/or detection levels, in various embodiments. Various embodiments include providing real time link quality scores to the user. Minimizing the measured wireless interference includes minimizing link quality scores, in an embodiment. The measured wireless interference can also be used to identify a source of the wireless interference, and to display an identity of the identified source of the wireless interference on the graphical display, in various embodiments.

Figure 4:
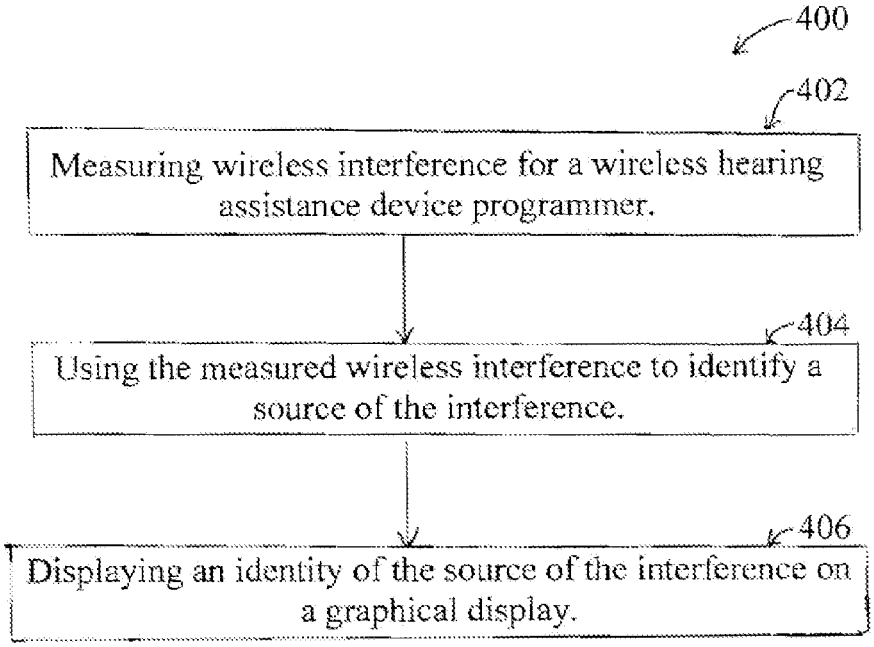
FIG. 4 illustrates a flow diagram of a method for measuring and identifying sources of wireless interference for hearing assistance device programmers, according to various embodiments of the present subject matter.

FIG. 4 illustrates a flow diagram of a method 400 for measuring and identifying sources of wireless interference for hearing assistance device programmers, according to various embodiments of the present subject matter. Wireless interference is measured for a wireless hearing assistance device programmer, at 402. At 404, the measured wireless interference is used to identify a source of the interference. At 406, an identity of the source of the interference is displayed on a graphical display. According to various embodiments, the graphical display is also used to direct a user to physically move the wireless programmer or a hearing assistance device in communication with the wireless programmer to minimize the measured wireless interference. Measuring wireless interference includes testing for detection of a hearing assistance device, in an embodiment. In various embodiments, measuring wireless interference includes determining a combined score for detection and interference level. Displaying an identity of the identified source of the wireless interference on a graphical display includes using a graphical display attached to a personal computer in communication with the wireless programmer, in an embodiment. In other embodiments, displaying an identity of the identified source of the wireless interference on a graphical display includes using a graphical display on the wireless programmer.

Figure 5:
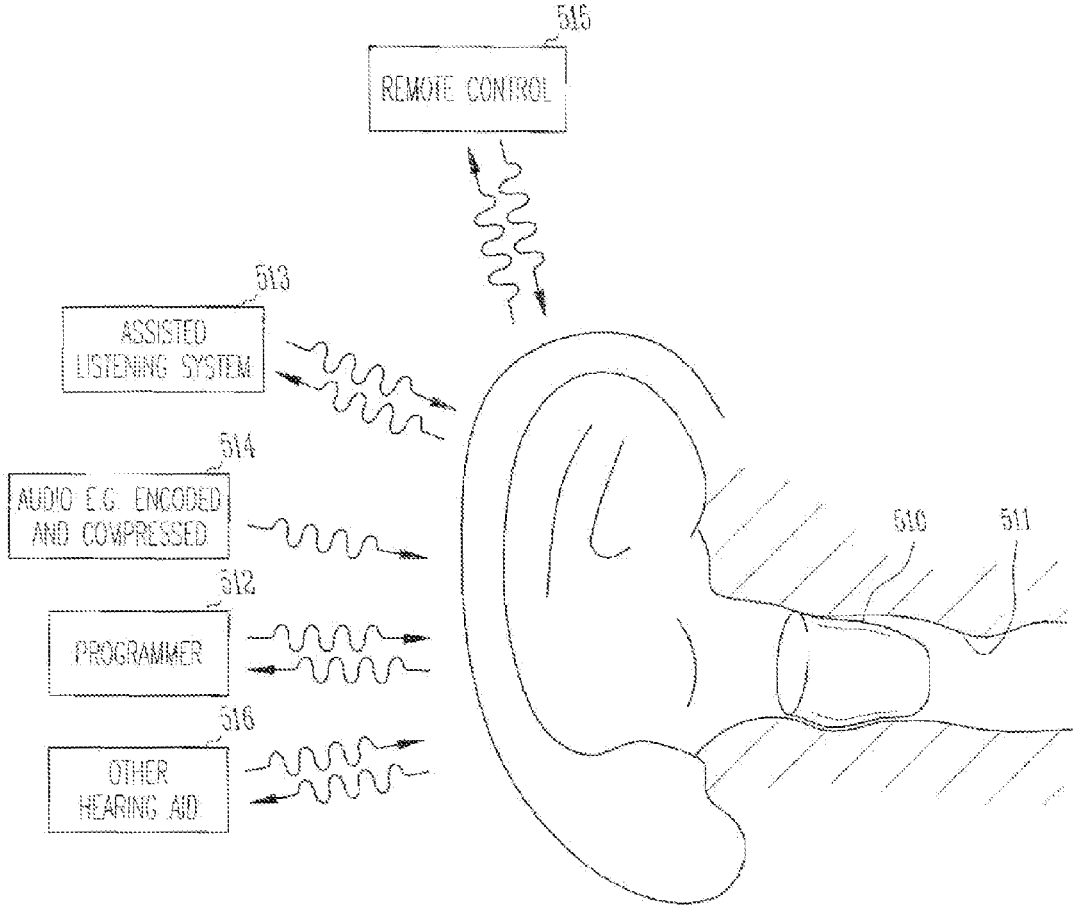
FIG. 5 illustrates various wireless communication environment(s) with a hearing aid device, according to various embodiments of the present subject matter.

FIG. 5 illustrates various wireless communication environment(s) with a hearing aid device, according to various embodiments of the present subject matter. The illustrated hearing aid device 510 is an in-the-ear hearing aid that is positioned completely in the ear canal 511. The present subject matter is not so limited, however. In addition to the illustrated in-the-ear style, the features of the present subject matter can be used in other styles of hearing assistance devices, including half-shell, in-the-canal, behind-the-ear, over-the-ear, eyeglass mount, implants, and body worn hearing aids, and further can be used in noise-protection earphones, headphones, and the like.

Referring again to FIG. 5, a wireless communication system in the hearing aid is adapted to communicate with one or more devices. In various embodiments, the hearing aid uses RF wireless communication to communicate with an external programmer 512. The programmer is able to adjust the hearing aid settings such as mode, volume and the like, to download a complete hearing aid program, and to receive data from the hearing aid for data logging, diagnostics, reporting and the like. In various embodiments, the hearing aid wirelessly communicates with an assisted listening system 513 to receive an audio signal, or a device 514 that provides encoded and compressed audio, or a remote control device 515, or another hearing aid 516, or various combinations thereof.

One challenging environment for hearing aid wireless communication involves a multi-office environment where several programmers may be within range of one another and attempt to discover nodes (e.g. hearing aids) simultaneously. In addition many nodes may be within range of each programmer. Furthermore, the multi-office environment may include other wireless services and/or otherwise devices that emit electromagnetic radiation that may adversely affect the desired wireless communication.

Figure 6:
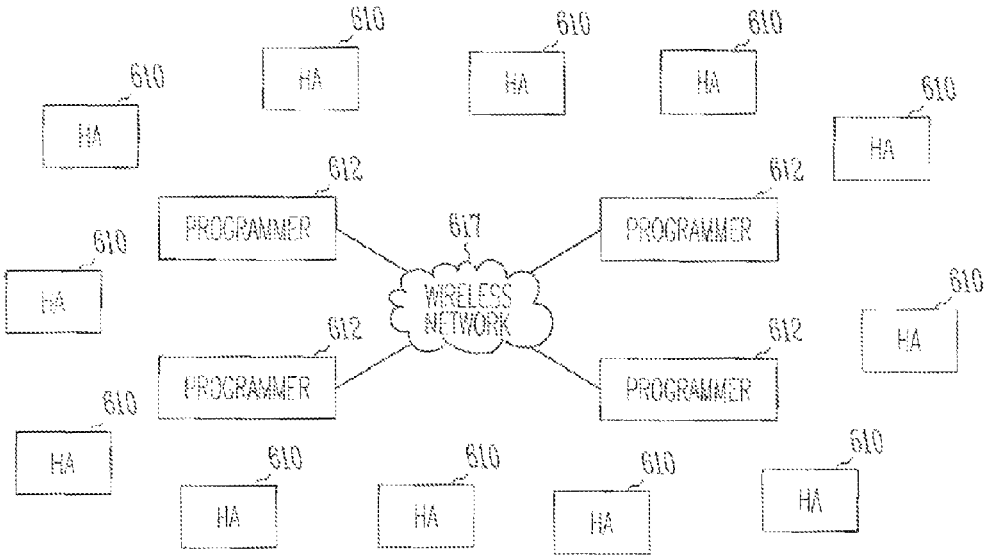
FIG. 6 illustrates a wireless communication network within a multi-office environment with multiple programmers and hearing aids.

FIG. 6 illustrates a wireless communication network within a multi-office environment with multiple programmers and hearing aids. Any of the programmers 612 are capable of discovering and communicating with hearing aids 610. Further, the programmers 612 can be wirelessly networked together, such as illustrated by the wireless network 617. Additionally, some hearing aids (e.g. left/right hearing aids for a patient) can be designed to wireless communicate with each other in addition to the programmers 612 or other communicators.

Some hearing aid embodiments incorporate a scanning feature to reduce the probability of interference. The probability that interference is on multiple channels simultaneously is significantly less, since the conditional probabilities for independent events are multiplied together for the overall probability that both channels will simultaneously experience interference. Interference can increase the duty cycle of the receiver since the detection of energy on a channel above a Receive Signal Strength Indicator (RSSI) threshold causes the receiver to stay awake. Thus, interference can adversely impact the battery life of the hearing aid. Some embodiments use a wake timer that, if the receiver is awake longer than the sleep cycle without receiving a valid packet, causes the receiver to go into a deep sleep mode with a longer sleep cycle until the interference goes away.

A system, such as the one illustrated in FIG. 6, performs a process to discover the nodes in operational proximity. Any number of channels can be assigned as discovery channels. The use of two or more discovery channels considerably increases the odds of successful links in comparison to a single discovery channel as the single channel may already be in use. These channels are reserved for node discovery of hearing aids by programmers. Programmers pick a desirable discovery channel based on a link quality assessment (LQA). Hearing aids scan the discovery channel frequencies prior to establishing a programming link. During discovery, programmers ping for nodes using a broadcast discovery message that is sent out at random intervals. The node is registered with the programmer if an acknowledgement is received by the programmer. Hearing aids register with all programmers in discovery mode within range of the hearing aid, and associate with programmers after being discovered and selected via the programmer's user interface. Once nodes are discovered, the user is notified using the user display of the hearing aids that are within range. The user then can select the nodes with which to establish a link.

Various programmer embodiments use a LQA table which is updated by scanning each available channel and is used by the programmer to determine a desirable channel, on which to establish a wireless communication session, among the available channels. The programmer sends a frequency change message to each hearing instrument. This message is acknowledged by the hearing aid. Normal data transfer to and from the hearing instrument can begin once the link has been established on the desired channel. Some programmer embodiments perform intermittent (e.g. periodic) maintenance throughout the wireless communication session. In some embodiments, the host communications device sends a maintenance message that contains the next available channel in case the link is lost due to interference as well as a transmit power control word. The channel maintenance response from the hearing instrument contains several communications metrics such as the number of successful packets received since the last maintenance response and the number of packets containing errors. This information is used by the programmer to determine the downlink quality and the uplink quality. The programmer is able to determine the downlink quality by comparing the number of no acknowledgments with the number of messages received by the hearing instrument. In addition to statistics collected during maintenance, some programmer embodiments monitor the RSSI of the nodes on each packet received. Some embodiments maintain this signal strength as a moving average in time. The signal strength can be used to adjust the power control of the uplink signal from the nodes. Adjustments can be made during maintenance messages. The links can operate on the fringe of link margin. However, if there is sufficient link margin, various embodiments allow for upstream power reduction (transmission from remote nodes/hearing aids to the host communications device) to save power in the remote nodes. As is discussed below, there are a number of ways to assess the link quality of RF communication links and a number of ways to adjust the RF communication based on the assessed link quality.

Figure 7:
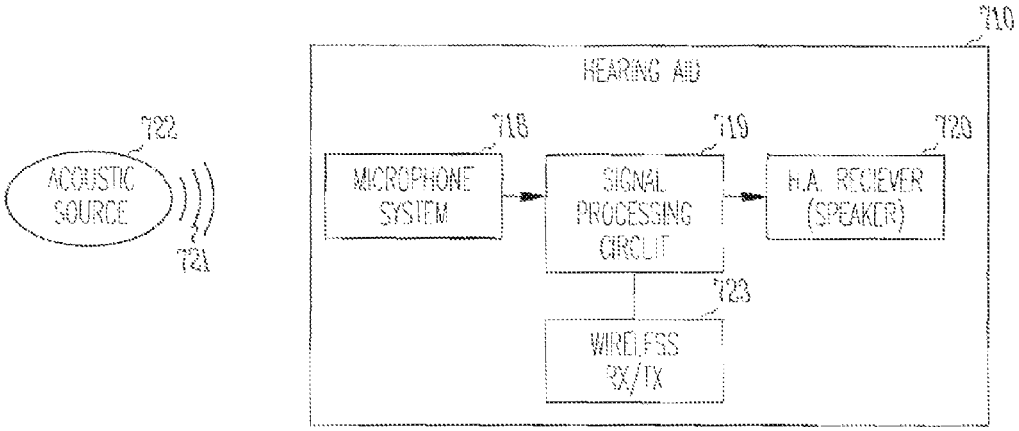
FIG. 7 illustrates a block diagram of a hearing aid embodiment.

FIG. 7 illustrates a block diagram of a hearing aid embodiment. The illustrated hearing aid 710 includes a microphone system 718, a signal processing circuit 719 which may be incorporated as part of a controller, and a speaker 720 referred to as a hearing aid receiver. The microphone system 718 transforms the acoustic energy 721 of sound from an acoustic source 722 into a signal representative of the sound. The signal processing circuit 719 receives the signal from the microphone system 718, and is designed (e.g. programmed) to appropriately adjust the signal to compensate for the hearing impairment of the wearer of the hearing aid. The signal processing circuit 719 outputs a processed signal to the hearing aid receiver 720, which converts the processed electrical signal into a sound perceived by the wearer. The illustrated hearing aid embodiment also includes a wireless communication circuit 723 adapted to transmit and/or receive wireless signals. The wireless communication circuit may include a receiver, a transmitter, or a transceiver. The signal processing circuit 719 (or controller) controls the wireless communication circuit 723 to control the wireless communication with other devices.

Figure 8:
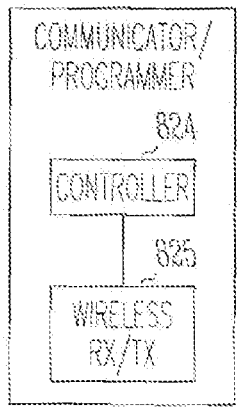
FIG. 8 illustrates a block diagram of a wireless programmer embodiment.

FIG. 8 illustrates a block diagram of a host wireless communicator, such as a programmer. The illustrated communicator includes a controller 824 and a wireless communication circuit 825 adapted to transmit and/or receive wireless signals. The wireless communication circuit may include a receiver, a transmitter, or a transceiver. The controller 824 controls the wireless communication circuit 825 to control the wireless communication with other devices. The station can include other elements, such as various input/output devices like a display monitor, keyboard and mouse.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method, comprising:

measuring a wireless interference level over wireless communication channels using a wireless programmer configured to communicate with a hearing assistance device;

identifying a source of wireless interference, wherein if the source of wireless interference is unknown, generating a log to send to customer support for diagnosis; and using a graphical display in communication with the wireless programmer to assist a user to physically move the wireless programmer or the hearing assistance device away from an identified source of the wireless interference to minimize the measured wireless interference level.

2. The method of claim 1, wherein using a graphical display in communication with the wireless programmer to assist a user to physically move the wireless programmer or the hearing assistance device includes providing real time link quality scores to the user.

3. The method of claim 2, wherein minimizing the measured wireless interference level includes minimizing link quality scores.

4. The method of claim 1, further comprising:

displaying an identity of the identified source of the wireless interference on the graphical display.

5. The method of claim 1, wherein using a graphical display includes using a graphical display attached to a personal computer in communication with the wireless programmer.

6. A method, comprising:

measuring wireless interference over wireless communication channels using fitting software configured for a wireless hearing assistance device programmer;

using the measured wireless interference to identify a source of the wireless interference;

if the source of the wireless interference is unknown, generating a log to send to customer support for diagnosis, and displaying an identity of the source of the wireless interference on a graphical display in communication with the wireless programmer, and using the display to assist a user to physically move the wireless programmer or the hearing assistance device away from the identified source.

7. The method of claim 6, further comprising:

using the graphical display to direct a user to physically move the wireless programmer or a hearing assistance device in communication with the wireless programmer to minimize the measured wireless interference.

8. The method of claim 6, wherein measuring wireless interference over wireless communication channels includes testing for detection of a hearing assistance device.

9. The method of claim 8, wherein measuring wireless interference over wireless communication channels includes determining a combined score for detection and interference level.

10. The method of claim 6, wherein displaying an identity of the identified source of the wireless interference on a graphical display includes using a graphical display attached to a personal computer in communication with the wireless programmer.

11. The method of claim 6, wherein displaying an identity of the identified source of the wireless interference on a graphical display includes using a graphical display on the wireless programmer.

12. A hearing assistance system for a wearer, comprising:

a wireless hearing assistance device programmer configured to wirelessly communicate with a hearing assistance device using at least one of a plurality of channels; and a graphical display in communication with the wireless programmer, wherein the wireless programmer is configured to measure wireless interference over the plurality of channels using fitting software configured for the wireless programmer, wherein if a source of the wireless interference is unknown, generating a log to send to customer support for diagnosis, and wherein the graphical display is configured to identify the source of the wireless interference and to provide direction to a user to physically move the wireless programmer or the hearing assistance device away from the identified source to minimize the measured wireless interference.

13. The system of claim 12, wherein the wireless programmer is adapted to identify a source of the measured wireless interference.

14. The system of claim 13, wherein the graphical display is configured to display an identity of the source of the measured wireless interference.

15. The system of claim 12, wherein the graphical display includes a graphical display attached to a personal computer in communication with the wireless programmer.

16. The system of claim 12, wherein the graphical display includes a graphical display on the wireless programmer.

17. The system of claim 12, wherein the hearing assistance device in a hearing aid.

18. The system of claim 17, wherein the hearing aid includes an in-the-ear (ITE) hearing aid.

19. The system of claim 17, wherein the hearing aid includes a behind-the-ear (BTE) hearing aid.

* * * * *